US005681191A

United States Patent [19]

Robicheau et al.

[11] Patent Number: 5,681,191

[45] Date of Patent: Oct. 28, 1997

[54] FLAG GROUNDING CONNECTOR

[75] Inventors: Richard E. Robicheau, Amherst; Gary W. Di Troia, Nashua, both of N.H.

[73] Assignee: Framatome Connectors USA Inc., Norwalk, Conn.

[21] Appl. No.: 517,752

[22] Filed: Aug. 22, 1995

[51] Int. Cl.[6] ..... H01R 4/10

[52] U.S. Cl. ..... 439/877; 439/92; 439/881

[58] Field of Search ..... 439/421, 422, 439/877–883, 92, 95, 108, 885

[56] References Cited

U.S. PATENT DOCUMENTS

| | | | |
|---|---|---|---|
| D. 302,542 | 8/1989 | O'Loughlin | D13/26 |
| 1,683,418 | 9/1928 | Shaw et al. | 439/877 |
| 2,511,806 | 6/1950 | Macy | 173/361 |
| 2,601,276 | 6/1952 | Gordon | 439/877 |
| 3,233,211 | 2/1966 | Smith | 439/877 |
| 3,310,773 | 3/1967 | Baenziger et al. | 339/276 |
| 3,670,298 | 6/1972 | Klumpp, Jr. | 339/276 T |
| 4,298,243 | 11/1981 | Swengel, Jr. et al. | 339/276 F |
| 4,771,538 | 9/1988 | O'Loughlin et al. | 29/874 |
| 4,993,959 | 2/1991 | Randolph | 439/92 |

*Primary Examiner*—J.J. Swann
*Attorney, Agent, or Firm*—Perman & Green, LLP

[57] ABSTRACT

A one-piece flag-shaped electrical terminal with a first section and a second section. The first section is flat and has mounting holes. The second section has a general "U" shape. The first section extends off of a leg of the general "U" shape of the second section.

10 Claims, 2 Drawing Sheets

FIG. 4
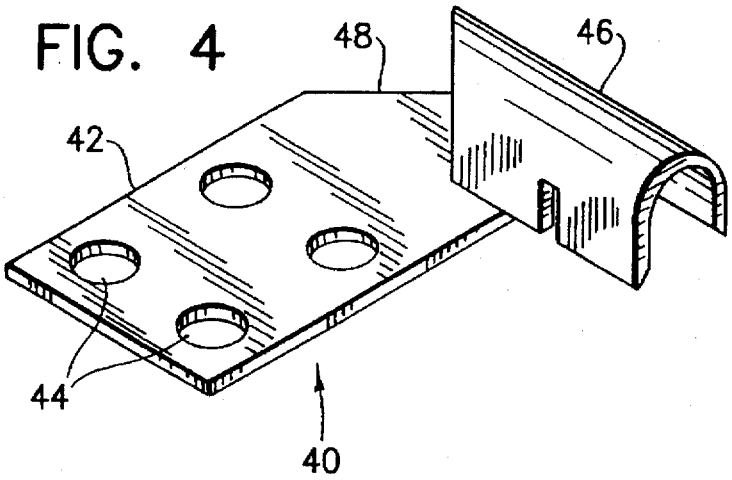
FIG. 5
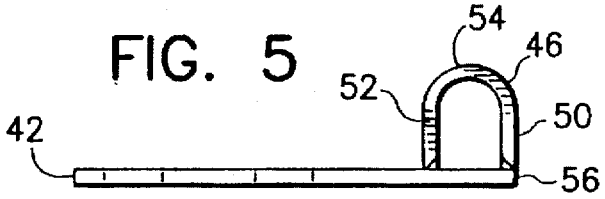
FIG. 6
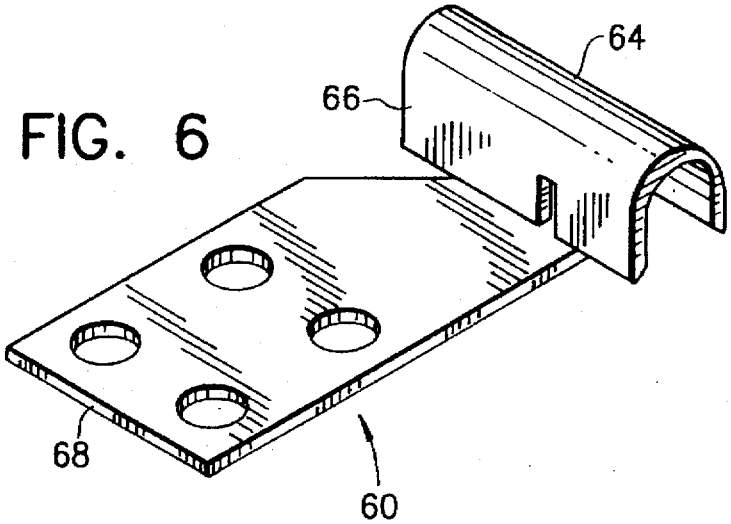
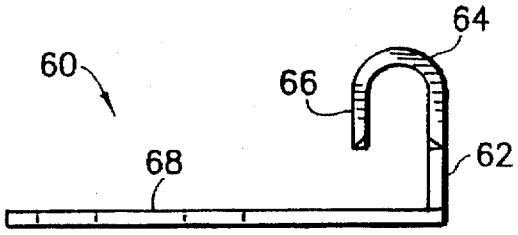
FIG. 7

FLAG GROUNDING CONNECTOR

BACKGROUND OF THE INVENTION

1. Field of the Invention

The present invention relates to electrical connectors and, more particularly, to a flag-shaped terminal.

2. Prior Art

U.S. Pat. No. 4,771,538 discloses a flag-shaped connector. Other different types of terminal can be found in the following U.S. Pat. Nos.: 2,511,806; 3,310,773; 3,670,298; 4,298,243 and Des. Pat. No. 302,542. Thomas & Betts produces a flag-shaped grounding terminal (model GFL 10–20) with an upright "U" shaped section offset from the flag surface plane.

SUMMARY OF THE INVENTION

In accordance with one embodiment of the present invention, a one-piece flag-shaped electrical terminal is provided comprising a first flat section and a second U-shaped section. The first flat section has a plurality of mounting holes. The second U-shaped section is connected to the first flat section. The first flat section extends straight off of a first leg of the U-shaped section parallel to a second leg of the U-shaped section.

In accordance with another embodiment of the present invention, a one-piece flagged-shaped electrical terminal is provided comprising a first flat section and a second U-shaped section. The first flat section has apertures therethrough. The second U-shaped section is connected to the flat section. The second U-shaped section has two parallel legs connected by a curved section. The U-shaped section extends from a side end of the first flat section with one of the legs of the second U-shaped section extending directly off of the first flat section at an angle.

In accordance with one method of the present invention, a method of forming a one-piece flag-shaped electrical terminal is provided comprising forming a one piece flat metal member with a first section having apertures therethrough and a second section; and bending the second section in only one direction towards the first section to form a general U-shape.

BRIEF DESCRIPTION OF THE DRAWINGS

The foregoing aspects and other features of the present invention are explained in the following description, taken in connection with the accompanying drawings, wherein:

FIG. 4 is a perspective view of an alternate embodiment of the present invention;

FIG. 5 is an elevational front view of the terminal shown in FIG. 4;

FIG. 6 is a perspective view of an alternate embodiment of the present invention; and FIG. 7 is a front elevational view of the terminal shown in FIG. 6.

DETAILED DESCRIPTION OF THE PREFERRED EMBODIMENTS

Figure 1:
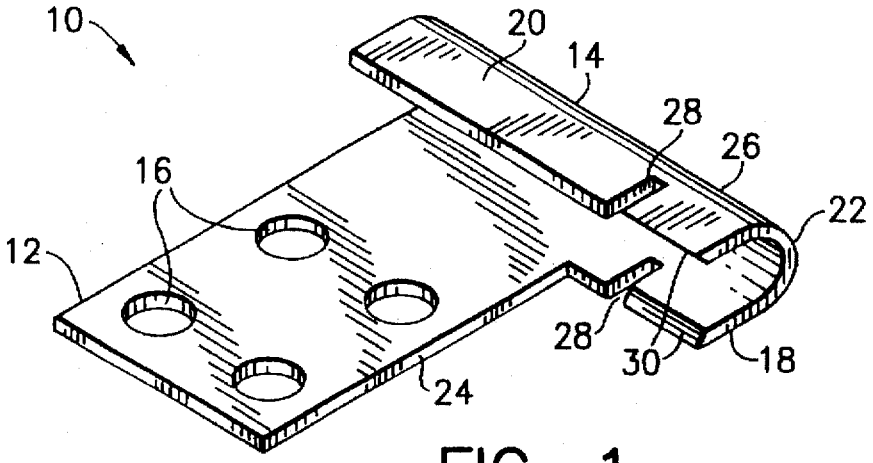
FIG. 1 is a perspective view of a one-piece flag-shaped electrical terminal incorporating features of the present invention.

Referring to FIG. 1, there is shown a perspective view of a one-piece flag-shaped electrical terminal 10 incorporating features of the present invention. Although the present invention will be described with reference to the embodiments shown in the drawings, it should be understood that the present invention can be embodied in various different forms of alternate embodiments. In addition, any suitable size, shape or type of elements or materials could be used.

Figure 3:
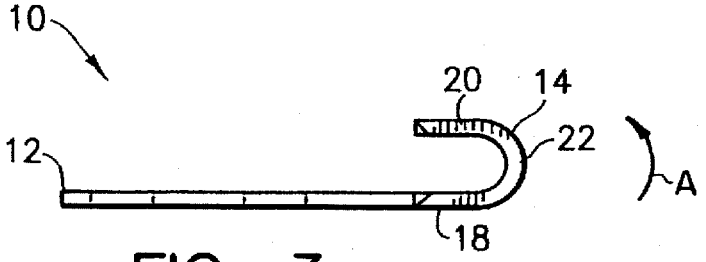
FIG. 3 is an elevational front view of the terminal shown in FIG. 1.

The terminal 10 is comprised of a one-piece metal member. Referring also to FIG. 3, the terminal 10 has a first flat section 12 and a second U-shaped section 14. The flat section 12 has four holes or apertures 16 therethrough. However, in alternate embodiments any suitable number of holes could be provided. The U-shaped section 14 has a general "U" shape with two legs 18, 20 and a curved section 22. The U-shaped section 14 extends off of a side end of the first flat section 12. In this embodiment the flat section 12 extends straight off of a first bottom leg 18 of the U-shaped section 14 parallel to the second top leg 20. The U-shaped section 14 has a front portion 26 that extends past a front edge 24 of the first flat section 12. The front portion 26 has two notches or indents 28; one in each of the legs 18, 20. The ends 30 of the legs 18, 20 in front of the notches 28 are angled. The notches 28 allow easier crimping of the legs 18, 20 in the front portion 26 onto a conductor (not shown) inserted into the U-shaped section.

Figure 2:
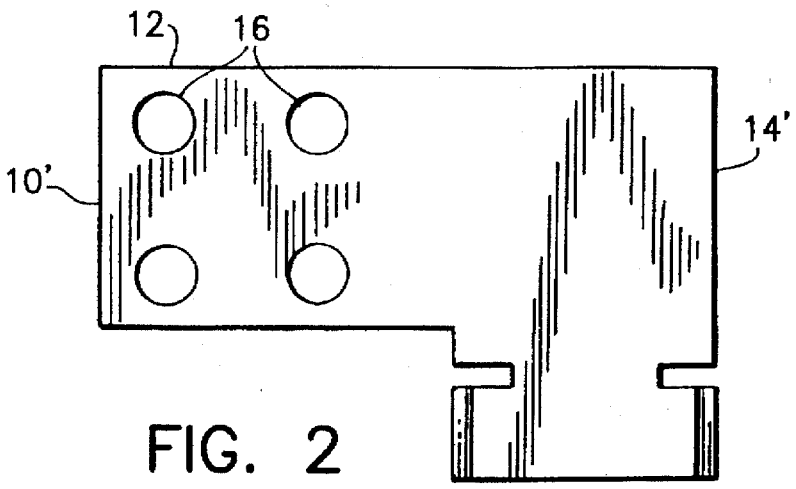
FIG. 2 is a plan top view of a one-piece blank member used to form the terminal shown in FIG. 1.

Referring also to FIG. 2, there is shown a plan top view of a flat metal blank 10' used to form the terminal 10. The method of manufacturing the terminal 10 merely comprises forming the blank 10' with the two sections 12 and 14', and then bending or rolling the flat second section 14' into its general "U" shape. When the flat blank 10' is formed, the first section 12 is complete and includes its holes 16. Bending of the second section 14' is only in one direction A shown in FIG. 3. This single bending action forms the curved section 22 of the general "U" shape. No further manufacturing is needed. The terminal 10 is then finished. Indents in the original stamping, or produced later by a secondary cutting operation, can mark the minimum wire insertion depth and reduce crimp force necessary to complete the electrical connection. The stamping die draws and cuts the "U" area at an angle, which allows the crimp operation to fold one side under the other.

Referring now to FIGS. 4 and 5, an alternate embodiment of the present invention is shown. The terminal 40 has a flat first section 42 with holes 44 and a general U-shaped second section 46. The rear of the first section 42 at area 48 proximate the second section 46 is angled to reduce weight and material used to make the terminal 40. This angle or cut-off of material is carried forward throughout the rear end of the U-shaped second section 46. The U-shaped section 46 has two legs 50, 52 and a curved section 54. In this embodiment the junction 56 between the first and second sections 42, 46 is angled at a 90° angle. Thus, the first leg 50 extends from the flat section 42 at a right angle. In alternate embodiments the junction 56 could have any suitable angle between 0° and 90°. The bend at junction 56 turns the U-shaped section 46 up-side-down relative to the plane of the first section 42. This embodiment demonstrates a minimum offset. In this configuration the conductor must be fed through the front end. The minimum offset feature allows the crimping tool to be place around the up-side-down "U" even when bolted to a flat surface. The method of manufacturing the terminal 40 is substantially the same as the method used for terminal 10. However, an added step is provided to form the appropriate bend or angle at junction 56. Thus, the one-piece flat blank is only bent twice; once to form the curved section 54 and once to form the junction 56.

Referring now to FIGS. 6 and 7, an alternate embodiment of the present invention is shown. The terminal 60 is substantially similar to the terminal 40 shown in FIG. 4. However, in this embodiment a first leg 62 of the second section 64 is longer than the other leg 66 to form a larger offset from the flat section 68. Thus, the second section has an upside down "J" shape off of the first flat section 68. With this embodiment, multiple flag connectors 60 may be pre-attached to a bus bar network. Then, a continuous run of cable may be strung through all of the U-shaped sections prior to crimping. The unique upside down "U" feature captures the wire (whether floor, wall or ceiling mounted) and prevents it from falling out of the connector regardless of orientation. This capture affect will benefit users by (1) reducing installation time, (2) allowing a conductor to be run prior to permanently crimping, and (3) allowing the conductor to be checked for length and location before it is crimped and immovable.

The above described embodiments have the advantage of using less material to manufacture. They also require non-specialized metal forming operations. The reduction in complicated metal forming reduces internal stress within the metal, resulting in a stronger connector. All design methods are easily tailored to specific needs. The offset height of terminal 60 is simply a function of where the 90° bend is made. This height may be easily changed for particular applications where it is desired that the wire be pressed through the opening for additional capture affect prior to crimping. The "U" location is a function of the original stamping, and may be extended any distance from the flag body, as required. Further, adding length to the "U" section (by easily relocating the indents) may accommodate multiple crimps for heavy duty applications.

It should be understood that the foregoing description is only illustrative of the invention. Various alternatives and modifications can be devised by those skilled in the art without departing from the spirit of the invention. Accordingly, the present invention is intended to embrace all such alternatives, modifications and variances which fall within the scope of the appended claims.

What is claimed is:

1. A one-piece flag-shaped electrical terminal comprising:

a first flat section having a plurality of mounting holes; and a second U-shaped section connected to the first flat section, wherein the first flat section extends straight off of a first leg of the U-shaped section parallel to a second leg of the U-shaped section, wherein the second U-shaped section has two notches in its legs that extend, respectively, into the legs from end edges of each leg.

2. A terminal as in claim 1 wherein the first flat section has four mounting holes.

3. A one-piece flag-shaped electrical terminal comprising:

a first flat section with apertures therethrough; and a second U-shaped section connected to the first flat section, the U-shaped section having two parallel legs connected by a curved section, wherein the U-shaped section extends from a side end of the first flat section with one of the legs of the U-shaped section extending directly off of the first flat section at an angle, wherein the legs each have a separate notch therein, each notch extending into its respective leg from an end edge of the leg.

4. A terminal as in claim 3 wherein one leg is longer than the other leg.

5. A terminal as in claim 3 wherein a rear of the U-shaped section is angled.

6. A terminal as in claim 5 wherein a rear of the first flat section at the second U-shaped section is angled.

7. A terminal as in claim 3 wherein a rear of the first flat section at the second U-shaped section is angled.

8. A terminal as in claim 3 wherein the angle is about 90°.

9. A terminal as in claim 3 wherein the second U-shaped section has a front that projects past a front edge of the first flat section.

10. A terminal as in claim 4 wherein the U-shaped section forms a general "J" shape.

* * * * *